US005132591A

United States Patent [19]

Santonja et al.

[11] Patent Number: 5,132,591

[45] Date of Patent: Jul. 21, 1992

[54] TRAVELLING-WAVE TUVE PROVIDED WITH A BRAZED "T" SHAPED HELIX DELAY LINE

[75] Inventors: Noël Santonja, Creteil; Dominique Henry, Elancourt, both of France

[73] Assignee: Thomson Tubes Electroniques, Boulogne Billancourt, France

[21] Appl. No.: 505,488

[22] Filed: Apr. 6, 1990

[30] Foreign Application Priority Data

Apr. 21, 1989 [FR] France ..... 89 05321

[51] Int. Cl.[5] ..... H01J 23/27

[52] U.S. Cl. ..... 315/3.5; 315/39.3; 333/162

[58] Field of Search ..... 315/3.5, 3.6, 39.3, 315/39 TW; 333/162; 29/600

[56] References Cited

U.S. PATENT DOCUMENTS

| | | | |
|---|---|---|---|
| 2,889,487 | 6/1959 | Birdsall et al. | 315/3.6 |
| 4,185,225 | 1/1980 | Doehler et al. | 315/3.5 |
| 4,263,532 | 4/1981 | Grosset | 315/3.5 |
| 4,264,842 | 4/1981 | Galuppi | 315/3.5 |

FOREIGN PATENT DOCUMENTS

| | | | |
|---|---|---|---|
| 2095468 | 9/1982 | United Kingdom | 315/3.5 |

OTHER PUBLICATIONS

International Electron Devices Meeting, San Francisco, CA, Dec. 13-15, 1982, pp. 18-21, IEEE, New York, U.S.; R. M. Phillips: "Some Surprising helical interaction circuits may hasten millimeter waves".

*Primary Examiner*—Eugene R. Laroche
*Assistant Examiner*—Benny T. Lee
*Attorney, Agent, or Firm*—Oblon, Spivak, McClelland, Maier & Neustadt

[57] ABSTRACT

Disclosed is a travelling-wave tube with helix. The helix is mounted in a metal sleeve and is held in a centered position by at least three dielectric rods. Parts of the helix are in contact with the rods. The helix is made out of a thin strip of a metal that is a good conductor of heat and electricity. Instead of having a rectangular cross-section, the thin strip now has a T-shaped cross-section, at least at all the parts of the helix that are in contact with the rods. The base of the T is brazed to the rods. This structure prevents the risk of electric arcs at the facing brazing beads on two consecutive turns of the helix. The disclosure can be applied to travelling-wave tubes operating in wide bandwidth and at high peak power and/or mean power values.

12 Claims, 3 Drawing Sheets

TRAVELLING-WAVE TUVE PROVIDED WITH A BRAZED "T" SHAPED HELIX DELAY LINE

BACKGROUND OF THE INVENTION

1. Field of the Invention

The present invention concerns travelling-wave tubes with operation in wide bandwith and at high peak power and/or mean power levels.

A travelling-wave tube is formed by the association of a long, thin electron beam and a structure, such as a delay line, designed to guide a microwave that has to be amplified. This delay line is quite often made with a thin metal strip, with a substantially rectangular cross-section, helically wound in forming non-contiguous turns. Thus a helix is obtained.

This helix is held, centered by dielectric rods, in a metal sleeve that forms the body of the travelling-wave tube. The number of rods is generally greater than or equal to three.

2. Description of the Prior Art

In the prior art, the helix is made with a thin, substantially rectangular-sectioned strip of a metal that is a good conductor of heat and electricity. The helix is brazed to the rods which are themselves brazed to the inside of the sleeve. The helix is made of copper for example. Quite often, a sleeve, also made of copper, and rods made of beryllium oxide are used. Since copper has a low electrical resistivity, the Joule's heat losses will be low. Owing to the high thermal conductivity of copper, at the brazing joints efficient heat dissipation is obtained along the helix and the sleeve. The heating of the helix will be reduced to the minimum and will enable operation and high peak power and/or mean power values. This kind of a structure may be used in wide-band travelling-wave tubes.

This structure nevertheless has one drawback. There are inevitably brazing beads at the helix/rod interface. If a brazing is to be reliable, it is preferable that an accumulation of brazing material or bead should go over on either side of the turn of the helix. Each bead is in contact with one side of the turn and with the rod.

During pulsed operation at very high power, due to the needle effect (by which electrical charges accumulate at the tip of a pointed body that is electrified), electrical arcs might be created between two facing beads located on two consecutive turns.

Travelling-wave tubes provided with such helical windings are therefore limited in terms of peak power value.

SUMMARY OF THE INVENTION

The present invention seeks to overcome these drawbacks by proposing a travelling-wave tube, comprising a brazed helical delay line, capable of working at high peak power and/or high mean power values. To this end, it is sought to get rid of the needle effects.

The present invention proposes a travelling-wave tube comprising a helical delay line mounted in a metal sleeve and kept centered by at least three dielectric rods, the helix having parts of its external surface brazed to the rods wherein, in order to get rid of the needle effect between two facing brazing joints on a rod, the helix is made out of a metal strip, the cross-section of which is substantially T-shaped, at least at all the parts of the helix brazed to the rods, the base of the T being brazed to the rods.

The helix could either be entirely made of a metal that is a good conductor of heat and electricity, or it could be formed by the assembly of two layers of metal, one stacked on the other. In the latter case, a metal that is a good conductor of heat and electricity will be used to make the layer brazed to the rods. The layer brazed to the rods will be either continuous or discontinuous.

The layer of metal located towards the interior of the helix will be either a refractory metal or a metal that is a good conductor of heat and electricity.

The two layers will be joined by brazing or by any other known means.

BRIEF DESCRIPTION OF THE DRAWINGS

The invention will be understood more clearly and other characteristics will appear from the following description, given as a non-restrictive example, and from the appended figures, of which.

DESCRIPTION OF THE PREFERRED EMBODIMENT

Figure 1:
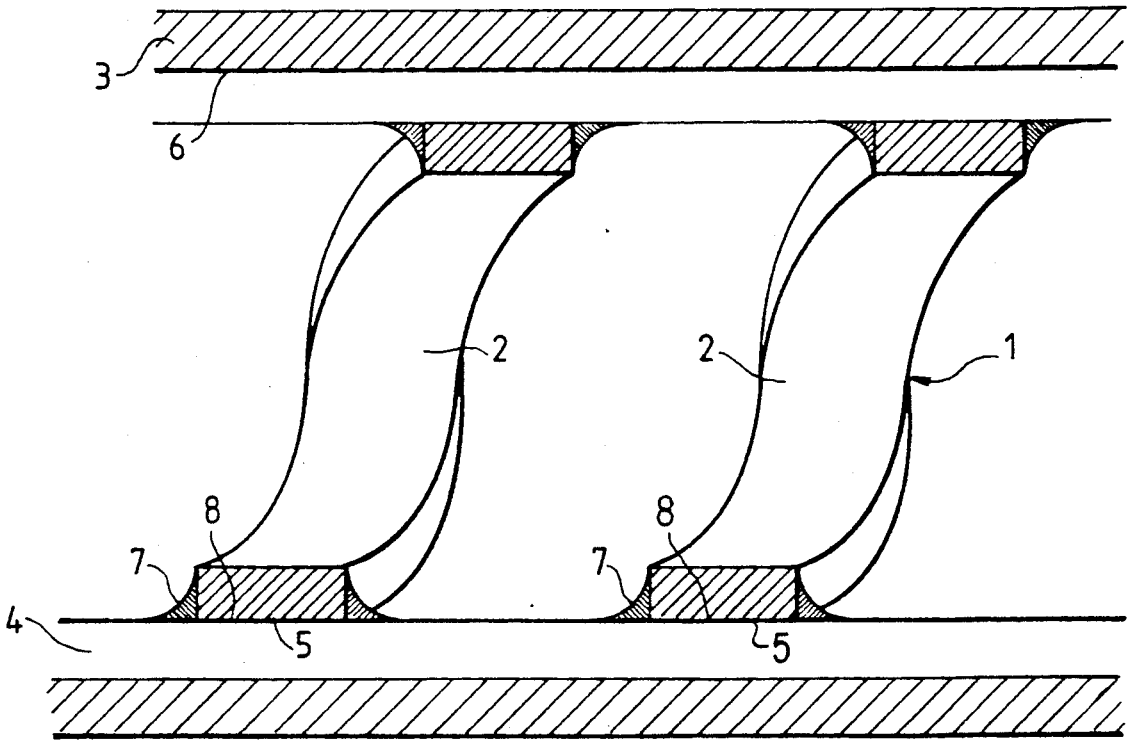
FIG. 1 PRIOR ART
FIG. 1 shows a longitudinal sectional view of a helical delay line of a travelling-wave tube, said helix being brazed according to the prior art.

FIG. 1 shows a helical delay line of a travelling-wave tube. This helical delay line has the reference 1. This helix 1 has a plurality of non-contiguous turns 2. The helix 1 is mounted in a metal sleeve 3. It is held at the center of the sleeve 3 by dielectric rods 4. Their number is equal to or greater than three. Some zones 8 of contact are defined between the helix 1 and the rods 4. The helix 1 is made from a thin strip of a metal that is a good conductor of heat and electricity, such as copper. This thin strip has a substantially rectangular section. The helix 1 is fixedly joined to the rods 4 by brazing joints 5, located at the parts 8 in contact with the rods 4. The rods 4 are themselves fixedly joined to the sleeve 3 by brazing joints 6. The materials used for the helix 1, the rods 4 and the sleeve 3 should be capable of standing up to deformations that may occur during brazing. This leads to the choice, preferably, of copper for the sleeve 3 and beryllium oxide for the rods 4.

When a turn 2 is brazed to the rod 4, brazing material inevitably flows over on either side of the turn and forms brazing beads 7. These beads take support both on the vertical sides of the turn 2 and on the rod 4.

Owing to the needle effect, electric arcs may be created, between two facing beads 7 placed on two successive turns 2. A travelling-wave tube using this type of brazed helix 1 and working in pulsed mode will therefore have a limited peak power level.

Figure 2:
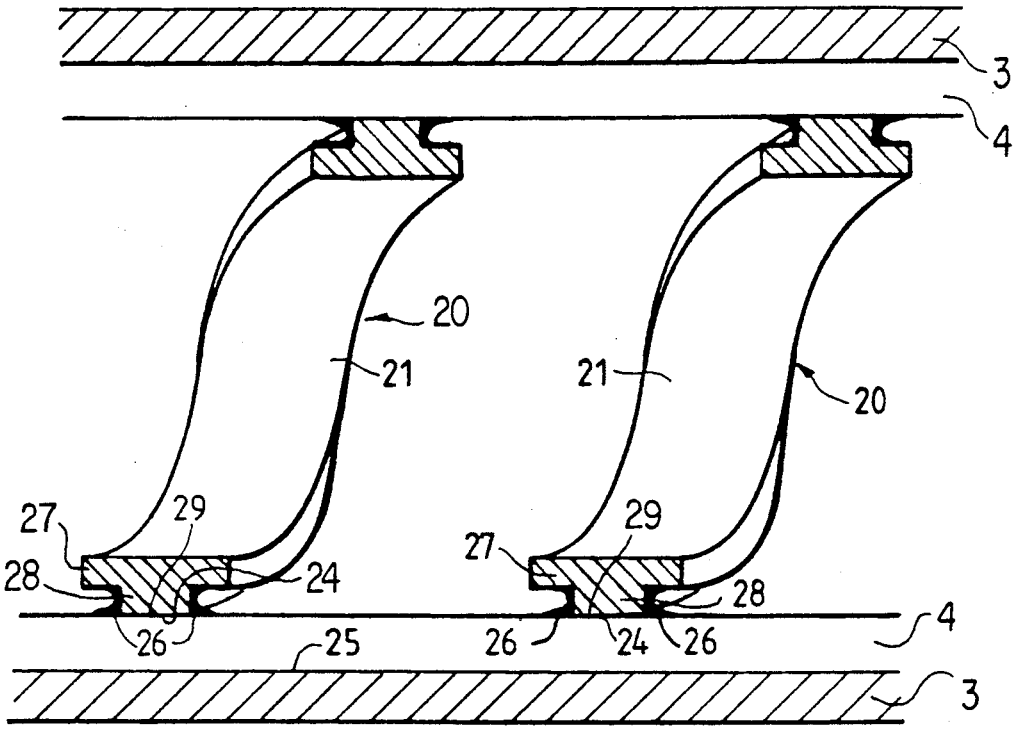
FIG. 2 shows a longitudinal sectional view of a helical delay line of a travelling-wave tube according to the invention.

FIG. 2 shows a longitudinal sectional view of a helical delay line of a travelling-wave tube mounted by brazing according to invention. The reference 20 represents the helix and the reference 21 represents a turn of the helix 20. Two consecutive turns 21 are not contiguous. This helix 20 is mounted in a metal sleeve 3. It is held at the center of this sleeve 3 by dielectric rods 4, the number of which is greater than or equal to three. The helix 20 has parts 29 of its external surface in contact with the rods 4. The helix 20 is fixedly joined to the rods 4 by brazing joints 24 at the parts 29. The rods 4 are themselves fixedly joined to the sleeve 3 by other brazing joints 25.

As in the structure described in FIG. 1, the helix 20 is made with a thin strip of metal which is a good conductor of heat and electricity. But now the cross-section of this thin strip, instead of being substantially rectangular, is substantially T-shaped throughout its length. The base 28 of the T is in contact with the dielectric rods while the cross bar 27 of the T is placed towards the interior of the helix 20. As earlier, there are brazing beads 26 at the interface between the helix 20 and the dielectric rods 4. The beads 26 are in contact with the base 28 of the T, its cross bar 27 and also the rods 4. The cross bar 27 of the T acts as an electric shield ahd enables the needle effect to be eliminated. Two facing beads 26 on two consecutive turns 21 will be further away from each other than in the prior art structure of FIG. 1. The risk of electric arcs is considerably reduced.

In this embodiment, the sleeve 3 will preferably be made of a metal that is a good conductor of heat and electricity, such as copper. The dielectric rods 4 will be, for example, made of beryllium oxide so as to stand up well to the brazing process.

Figure 4:
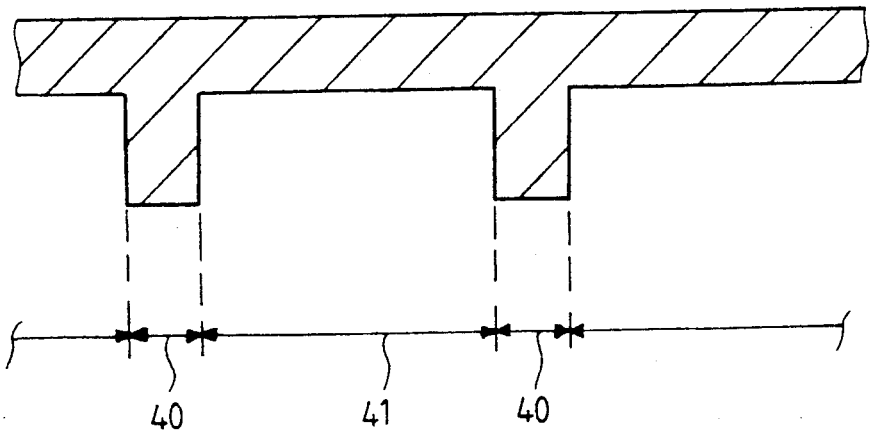
FIG. 4 shows a longitudinal section of a thin strip before it is wound, said thin strip being used to make the helix of an alternative embodiment of the travelling-wave tube according to the invention.

A structure may be envisaged where the thin strip has a T-shaped cross-section only at all the parts 29 of the helix 20 in contact with the rods 4. This alternative is shown in FIG. 4. The thin strip shown in a cross-section has not yet been wound. The thin strip is formed by a succession of first sections 40, the cross-section of which is T-shaped, separated from one another by second sections 41 with a substantially rectangular cross-section. The second sections 41 may have a cross-section corresponding to that of the cross bar of the T.

In these structures, the helix is made out of a strip of a metal which is a good conductor of heat and electricity. The cross-section of the metal strip is T-shaped at least in those parts of the external surface of the helix that are in contact with the rods. This strip is obtained by standard methods of wire drawing and/or machining.

Figure 3:
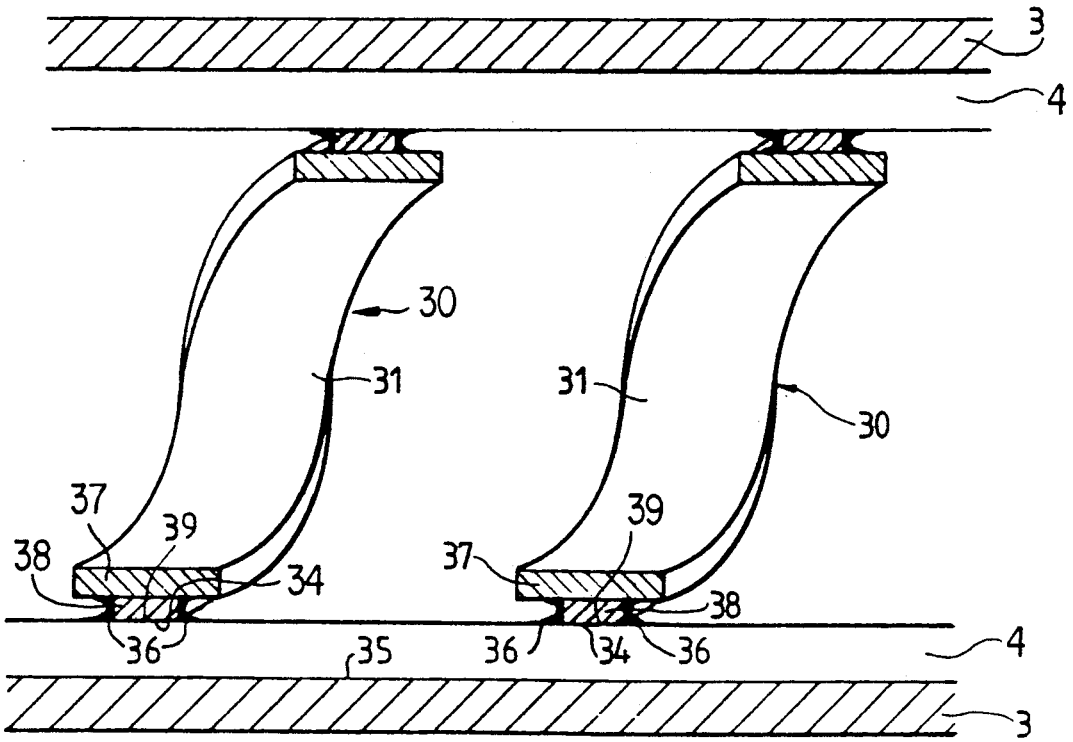
FIG. 3 shows an alternative embodiment of helical delay line of a travelling-wave tube according to the invention.

FIG. 3 shows a longitudinal sectional view of another alternative embodiment of a helical delay line of a travelling-wave tube according to the invention. The reference 30 represents the helix, and the reference 31 represents a turn. The helix 30 is kept centered by rods 4 in a sleeve 3. It has parts 39 of its external surface in contact with the rods 4. The helix 30 is fixedly joined to the rods 4 by brazing joints 34. There are brazing beads 36 at the interface between the helix 30 and the rods 4. The helix 30 is made out of a thin metal strip with a T-shaped cross-section, at least at the parts 39 in contact with the rods 4. Dielectric rods 4 are brazed to sleeve 3 by brazing joint 35.

However, in this alternative embodiment, the strip of metal used to make the helix 30 is formed by an assembly of a first layer 37 and a second layer 38, one stacked on the other. They are preferably brazed together by means of a brazing alloy. These two layers 37, 38 do not have the same width. The second layer 38, which is located towards the exterior of the helix 30, is narrower than the first layer 37 located towards the interior, so as to obtain the T shape.

The second layer 38 forms the base of the T while the first layer 37 forms its cross bar.

For the second layer 38, which is in contact with the dielectric rods 4, a metal that is a good conductor of heat and electricity, such as copper or aluminium, will be chosen. The first layer 37, which is turned towards the interior of the helix 30, may also be made of a metal that is a good conductor of heat and electricity, such as copper or aluminium. A structure could also be envisaged where this first layer 37, turned towards the interior, is made of another metal, for example a refractory and elastic metal such as molybdenum or tungsten.

As a precautionary measure, the cross-section of the strip used to make the helix will have only rounded corners as is the practice when working under high power.

Preferably, copper will be chosen to make the sleeve 3 and beryllium oxide will be chosen to make the dielectric rods 4.

Now, if the thin strip has a T-shaped cross-section only at the level of all the parts 39 of the helix in contact with the rods 4, the thin strip can be with the first layer 37 and a second layer 38, one stacked on the other. The second layer 38, located towards the exterior of the helix, will be narrower than the first layer 37. It will be in contact with the rods 4. It will be discontinuous. It will be deposited at all the parts 39 of the helix in contact with the rods 4. It could form the base of the T.

The first layer 37, located towards the interior of the helix, will be continuous. It could form the cross bar of the T at the parts 39 of the helix in contact with the rods 4.

There will be no change, either for the choice of the metals nor for the assembly, as compared with the previously described approach.

The invention is not restricted to the examples described, notably as regards the dimensions and materials of the helix.

What is claimed is:

1. A traveling wave tube comprising:

a metal sleeve, having a cylindrical inner surface and a cylindrical axis, at least three dielectric rods attached to said inner surface and parallel to said cylindrical axis, a helix made of a metal strip disposed inside said sleeve and arranged coaxial with said cylindrical axis, zones of contact wherein said helix contacts said rods, said metal strip having a "T" shaped cross section with a base portion and a cross bar portion, wherein the base portion of said "T" is brazed to said rods to define said zones of contact.

2. A traveling wave tube according to claim 1, wherein the metal strip has high thermal and electrical conductivity.

3. A traveling wave tube according to claim 2, wherein the metal strip is constituted by a chemical element that is a member of the group consisting of copper and aluminum.

4. A traveling wave tube according to claim 1, wherein the strip is formed of an inner layer of a first metal and, at least in the zones of contact between the helix and the rods, an outer layer of a second metal, the outer layer is brazed to the rods.

5. A traveling wave tube according to claim 4, wherein the second metal has high thermal and electrical conductivity.

6. A traveling wave tube according to claim 5, wherein the second metal is chosen from a member of the group consisting of copper and aluminum.

7. A traveling wave tube according to claim 4, wherein the first metal is a refractory metal.

8. A traveling wave tube according to claim 7, wherein the refractory metal is chosen from a member of the group consisting of tungsten and molybdenum.

9. A traveling wave tube according to claim 4, wherein the first metal has high thermal and electrical conductivity.

10. A traveling wave tube according to claim 9, wherein the first metal is chosen from a member of the group consisting of copper and aluminum.

11. A traveling wave tube according to claim 4, wherein the inner layer and the outer layer are bonded together by braze.

12. A traveling wave tube according to claim 1, further comprising:

brazing beads formed by brazing said helix to said rods at said zones of contact. each of said beads extends in a region adjacent to a zone of contact and contacts adjacent surface portions of the helix and the corresponding rod, said brazing beads include high curvature arc initiation sites which initiate arcs when an electric field at said sites exceeds a threshold value, and wherein said cross bar portion screens said arc initiation sites from electric fields in said tube.

* * * * *